US005168729A

United States Patent [19]

Metzner

[11] Patent Number: 5,168,729

[45] Date of Patent: Dec. 8, 1992

[54] SINGLE-LAYERED WARP WEAVE

[75] Inventor: Bernd Metzner, Augsburg, Fed. Rep. of Germany

[73] Assignee: Carl Albani Gardinenfabrick GmbH & Co., Augsburg, Fed. Rep. of Germany

[21] Appl. No.: 575,490

[22] Filed: Aug. 29, 1990

[30] Foreign Application Priority Data

Aug. 31, 1989 [DE] Fed. Rep. of Germany ..... 3928788

[51] Int. Cl.[5] ..... D04B 21/06

[52] U.S. Cl. ..... 66/193; 66/194; 66/195

[58] Field of Search ..... 66/195, 196, 193

[56] References Cited

U.S. PATENT DOCUMENTS

| | | | |
|---|---|---|---|
| 80,183 | 7/1868 | Jolley | 66/195 |
| 2,959,947 | 11/1960 | MacCaffray, Jr. | 66/193 |
| 3,434,306 | 3/1969 | Auville et al. | 66/195 |

FOREIGN PATENT DOCUMENTS

| | | | |
|---|---|---|---|
| 1027347 | 5/1953 | France | 66/195 |
| 46-33434 | 9/1971 | Japan | 66/195 |
| 849454 | 9/1960 | United Kingdom | 66/195 |

*Primary Examiner*—Werner H. Schroeder
*Assistant Examiner*—John J. Calvert
*Attorney, Agent, or Firm*—Pascal & Associates

[57] ABSTRACT

An improved warp knit having coloured surfaces comprised of three or more colours can be made across the same wales. Threads having a colour which is covered in one coloured surface run as floats, and threads with a colour forming the coloured surface are placed in a pattern connecting the floats with one another. A fabric or twill pattern extends across at least a number of wales which is less by 1 than the number of colours. Accordingly adjacent floats consist of at least two differently coloured threads.

3 Claims, 4 Drawing Sheets 0
2
4
2

0
2
2
0

0
2
6
4

SINGLE-LAYERED WARP WEAVE

FIELD OF THE INVENTION

This invention relates to the field of textiles, and particularly to warp knits having particular colored patterns.

BACKGROUND TO THE INVENTION

In order to produce different coloured surfaces in single-layered warp knits, it has thusfar been customary to work threads with two different colours across a number of rows of stitches, whereby the threads whose colour is to appear on one surface are worked in a tricot pattern and the threads of the other colour are worked as a float as wales. Thus, in the coloured surface, the visible threads of the one colour extend in a tricot pattern between the floats. If coloured surfaces of a third colour are to appear in the knit, then threads of the third colour are worked with those of the first or second colour in a corresponding manner across an additional number of wales. This means, therefore, that coloured surfaces of different colours can only appear adjacent to one another in separate wales in the pattern of the warp knit.

If coloured surfaces with three or more different colours are to appear across the same wales, then it is necessary to make the knit double-layered whereby threads of a first colour are worked in both surfaces. In addition, threads of a second colour are worked in the one surface and threads of the third colour are worked in addition in the other surface.

SUMMARY OF THE INVENTION

It is an object of the present invention to improve the single-layered warp knit in such a way that coloured surfaces comprising of three or more colours can be made across the same wales.

In accordance with an embodiment of the invention a single-layered warp knit in which the threads for forming different coloured surfaces have different colours, threads having a colour which is covered in one coloured surface running as floats, and threads with a colour forming the coloured surfaces being placed in a pattern connecting the floats with one another, a fabric or twill pattering extending across at least a number of wales which is less by 1 than then umber of colours, adjacent floats thereby consisting of at least two differently coloured threads.

The prior art and embodiments of the single-layered warp knit are explained in greater detail below with reference to the drawings, in which:

BRIEF INTRODUCTION TO THE DRAWINGS

DESCRIPTION OF PREFERRED EMBODIMENTS OF THE INVENTION

Figure 1:
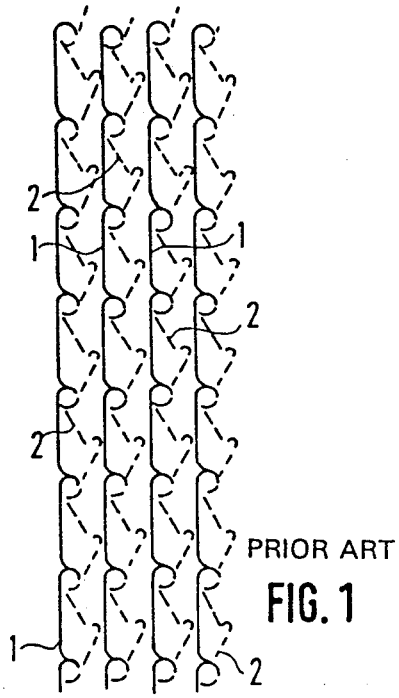
PRIOR ART FIG. 1
FIG. 1 is a single-layered warp knit according to the prior art.

In the drawings, solid lines signify uniformly black threads, broken lines red threads and dash-and-dot lines green threads.

In the prior art of FIG. 1, the black threads 1 are worked as floats, whereby adjacent floats are connected to one another by red threads 2, which are worked in a tricot pattern. In this way, a coloured surface in a red colour is obtained. If a black coloured surface is to be produced, then the red threads are worked in a float, while the black threads connect the float to one another in a tricot pattern. Thus, the illustrated warp knit can only have coloured surfaces in either red or black. According to the embodiment of the present invention shown in FIG. 2, a single-layered warp knit is produced which has three differently coloured surfaces, that is, an upper red coloured surface, a middle black coloured surface and a lower green coloured surface. Thus, three colours appear in the illustrated weave.

Red and black floats alternate with one another in the lower green coloured surface, while the green threads 3 are used to form a fabric pattern. The fabric patterning of the green threads 3 takes place across two wales respectively between the red floats. The fabric patterning of the green threads 3 can also take place across more than two wales.

At the transition to the black surface, i.e. in stitch row 4, the green threads are placed in a tricot pattern and then continued as green floats through the black field. Therefore, the green threads run in the same wales as floats, just as the black threads did previously in the green field. The red threads 2 are continued as floats just as in the green field. In the black field, therefore, the red and green floats alternate with one another. Starting at stitch row 4, the black threads 1 are placed in a fabric pattern across two wales each, that is, they extend between adjacent green floats.

At the end of the black field at stitch row 5, the black threads are placed about a tricot patterning and are subsequently continued as floats, namely, in the wales, in which the red floats previously ran. The green threads are continued as floats similarly as in the black field. The red threads, on the other hand, are placed in a fabric pattern, also again across two wales.

Similarly as the green threads 3, the black and red threads can also be placed in a fabric pattern across more than two wales.

Those threads which are each placed in a fabric pattern determine the colour of the respective field, whereas the colours of the threads placed in floats do not appear.

Figure 2:
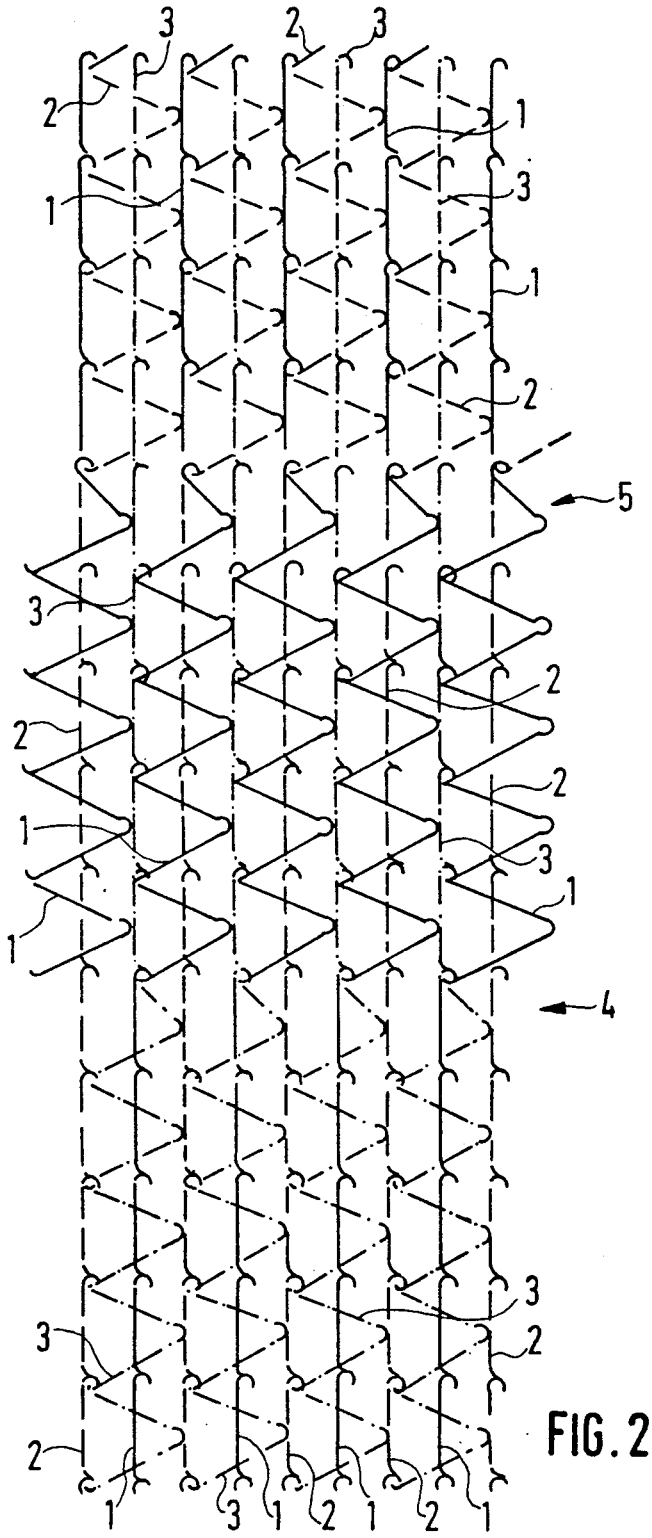
FIG. 2 is a first embodiment of the warp knit with fabric patterns.

The warp knit according to FIG. 2 can be produced whereby the threads of a first and second colour are each worked by one needle of two needles situated behind one another, whereas threads of the third colour are worked by an adjacent needle.

Figure 3:
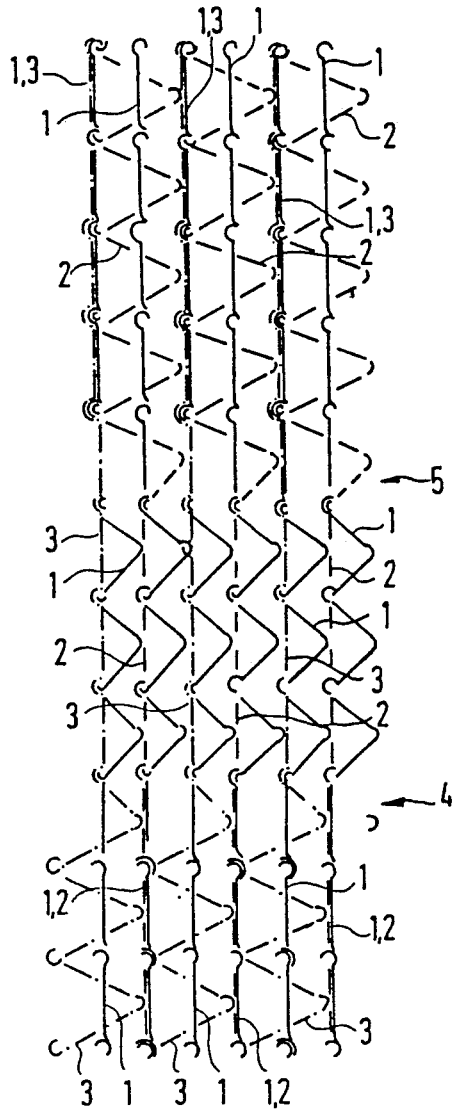
FIG. 3 is a second embodiment also in a fabric pattern.

In the arrangement of FIG. 3, a black and a red thread are worked by needles situated behind one another and a black and a green thread are worked by needles adjacent thereto which are situated behind one another.

In the lower green field, all the black threads 1 are worked into a float, whereby a red thread 2 is worked along into a fringe together with the black thread in every second wales respectively. The green threads 3, on the other hand, are placed in a fabric pattern, that is, between each of two double threads 1, 2 running in a float. Thus, they again extend across two wales, whereby the number of wales, as noted above, is not limited upward. At the end of the green field in stitch row 4, the green threads are placed in a tricot pattern and are then continued as green floats similar to those floats consisting only of black threads in the green field. In the black field, the red threads continue as floats similar to the floats in the green field consisting of double threads 1, 2. All the black threads are now put into a tricot pattern in the black field, that is, they extend between alternating red and green floats. At the end of the black field at stitch row 5, all the black threads again run as float patterned just as the green threads 3, so that floats from a black thread and floats from a black and a green thread alternate with one another. The red threads, on the other hand, are subsequently placed in a fabric pattern after a tricot patterning at stitch row 5 and therefore run between each of two adjacent double threads 1, 3 placed in floats.

This type of a knit is provided when its basic colour is black, since a sturdy warp knit results due to the tricot patterning in the black field.

Figure 4:
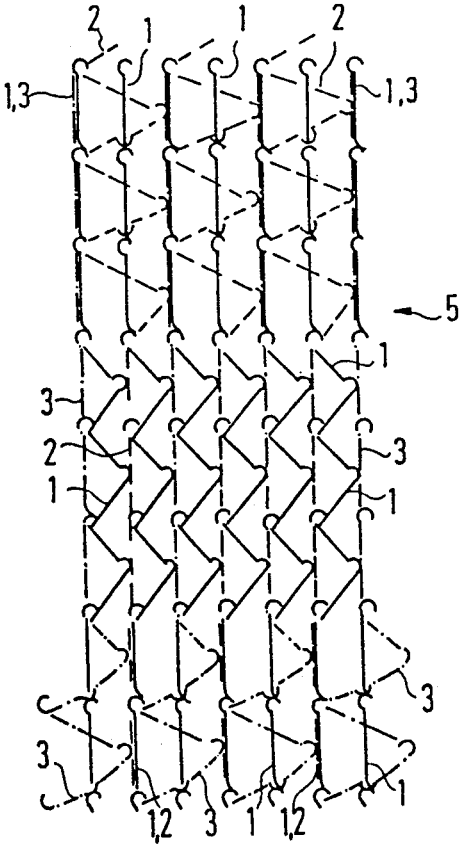
FIG. 4 is a third embodiment with twill patterns.

The design of the knit in FIG. 4 is identical to the one in FIG. 3, with the exception that the green threads 3 are twilled in the green field and the red threads 2 are twilled in the red field. As a result of this, the floats consisting only of black threads 1 are connected to one another in the green and red field.

Figure 5:
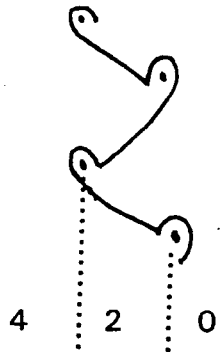
Fig. 5 PRIOR ART
FIGS. 5, 6 and 7 illustrate the course of the thread in accordance with the prior art.
Figure 6:
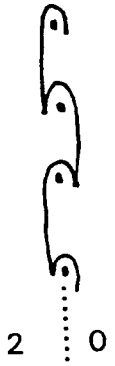
Fig. 6 PRIOR ART
Figure 7:
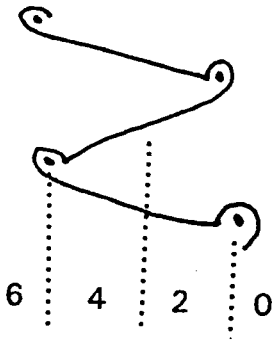
Fig. 7 PRIOR ART

In FIGS. 5, 6, and 7, the course of the thread in accordance with the prior art is illustrated. The number enumerate the spaces between the needles to a reference space which is numbered by "0" in the lateral direction. Each even number stands for one space. The numbering in FIG. 5 indicates that the thread makes a first stitch around the needle between spaced 0 and 2 and a second stitch around the next needles between the spaces 2 and 4. Then the procedure repeats.

To overcome the necessity of the illustrated zig-zag pattern, Jacquard machines use pressure bars which allows the thread to be transferred directly from space 2 to spaced 6, for example, or to be left at space 2 after making a stitch. These pressure bars are known in the state of the art and are used to manufacture the claimed warp knit.

FIG. 6 is a drawing of the thread course where the thread is left in the same space (2).

FIG. 7 illustrates the thread course where the thread is directed from space 2 to space 6 directly.

Figure 8:
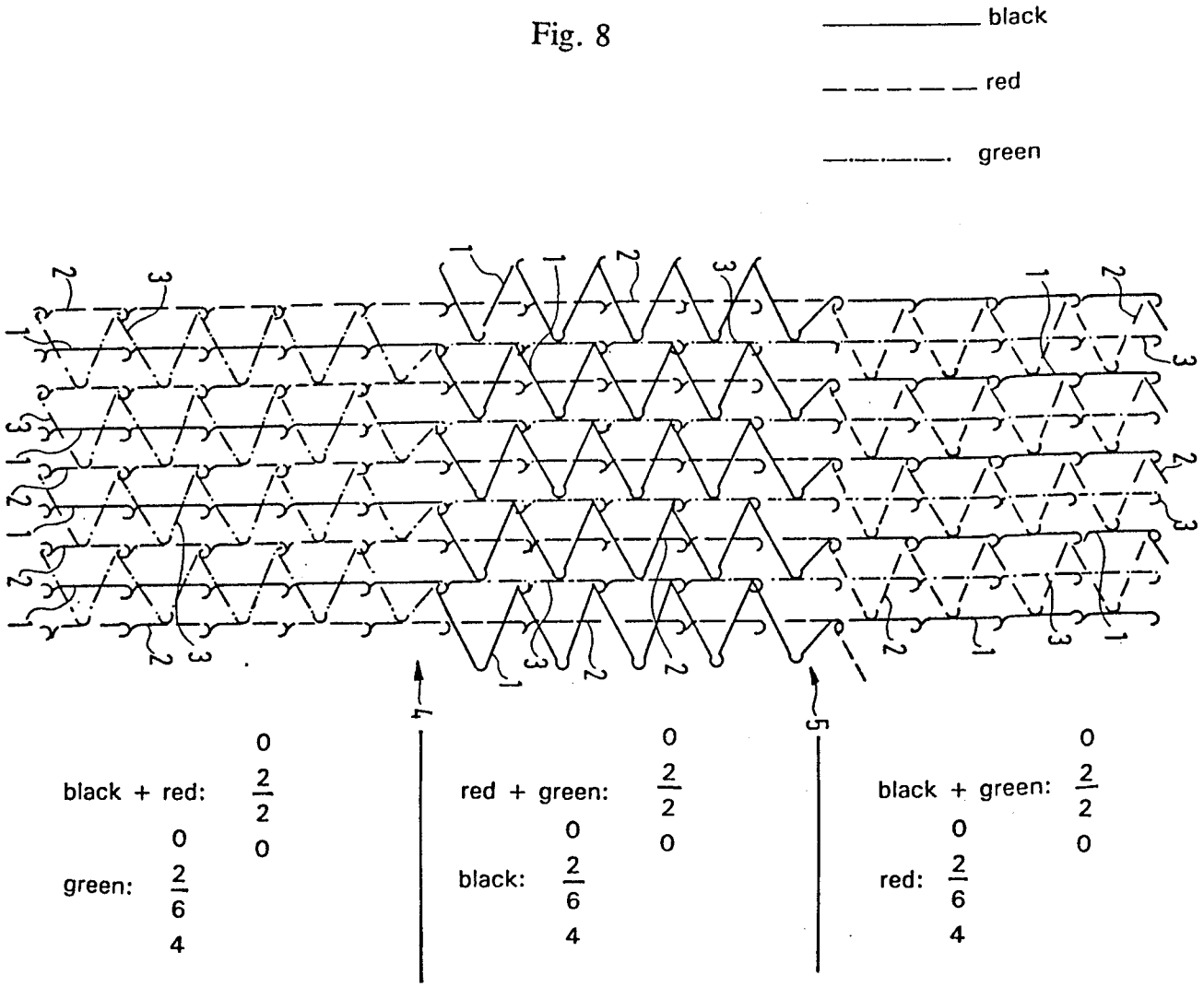
FIG. 8 is primarily a duplicate of FIG. 2, illustrating the invention with respect to different coloured threads.

FIG. 8 illustrates the structure and colours of the invention, and is a modified form of FIG. 2. It may be seen that any of the three coloured threads are available at any of the areas, and the zig-zag, which represent the colour in the area, is evident. Thus the fabric pattern created has three separate colour areas, the center are being black and the adjacent areas being red and green respectively.

I claim:

1. A single-layered warp knit having a back side and a surface and having different colored threads for forming a variously colored pattern surface comprising, threads knitted as floats of at least two colors are covered by threads of a different color and threads with the color forming the surface connecting the floats with one another to define the color of the fabric pattern, at least one of the colored threads forming the colored surface extends across at least a number of wales equal to one less than the number of colors.

2. A warp knit as defined in claim 1, wherein an equal quantity of threads of different colors extend through the knit, the patterning construction of the colored surface always being a tricot or twill.

3. A warp knit as defined in claim 1, wherein single and double threads alternate with one another in the floats, the single threads and one of the double threads always having the same color, the threads of said same color being placed in a tricot pattern when in the colored surface of said same color.

* * * * *